US005240251A

United States Patent [19]

Filice

[11] Patent Number: 5,240,251

[45] Date of Patent: Aug. 31, 1993

[54] SLIDING STREET HOCKEY PUCK

[75] Inventor: Gary W. Filice, Moorpark, Calif.

[73] Assignee: Easton Sports, Burlingame, Calif.

[21] Appl. No.: 806,616

[22] Filed: Dec. 12, 1991

[51] Int. Cl.[5] ..... A63B 71/02

[52] U.S. Cl. ..... 273/128 R

[58] Field of Search ..... 273/126 R, 126 A, 128 R, 273/128 CS, 128 A

[56] References Cited

U.S. PATENT DOCUMENTS

| | | | |
|---|---|---|---|
| 3,704,891 | 12/1972 | Chiarelli | 273/128 R |
| 3,784,204 | 1/1974 | Felber | 273/128 R |
| 3,797,057 | 3/1974 | Smelden | 273/128 R |
| 3,887,188 | 6/1975 | Beauchamp et al. | 273/128 R |
| 3,997,164 | 12/1976 | White, Sr. | 273/128 R |
| 4,078,801 | 3/1978 | White, Sr. | 273/128 R |
| 4,153,253 | 5/1979 | White, Sr. | 273/128 R |
| 4,555,114 | 11/1985 | Dozier | 273/126 R X |
| 4,801,144 | 1/1989 | DeMasi, Jr. et al. | 273/128 R |
| 5,014,990 | 5/1991 | Kaser et al. | 273/128 R |

*Primary Examiner*—V. Millin
*Assistant Examiner*—Raleigh W. Chiu
*Attorney, Agent, or Firm*—Flehr, Hohbach, Test, Albritton & Herbert

[57] ABSTRACT

A cylindrical sliding hockey puck with layers of bristle material attached to first and second ends for use on hard non-ice surfaces is described.

20 Claims, 1 Drawing Sheet

SLIDING STREET HOCKEY PUCK

FIELD OF THE INVENTION

The present invention relates generally to a sliding street hockey puck for use on hard non-ice surfaces such as concrete, asphalt, or flooring.

DESCRIPTION OF RELATED ART

Hockey pucks have been developed for use on hard non-ice surfaces such as concrete and asphalt. These pucks are designed to minimize the friction between the puck and the playing surface in order to simulate the behavior of an official hockey puck on ice. Examples of these pucks include a puck made by MYLEC, ROLL-A-PUCK ® made by Roll-A-Puck, Limited, and HOT-PUCKS made by Sun Hockey. The Roll-A-Puck design is described in U.S. Pat. No. 4,801,144.

The MYLEC puck is a lightweight soft vinyl puck which is lighter than the official hockey puck and has relatively high friction on these non-ice surfaces. This high friction causes the annoying tendency for the puck to flip and roll on its edge while causing loss of control during stick handling. High friction also prevents good passing and proper shooting. The ROLL-A-PUCK ® and HOT-PUCK have weights close to that of an official hockey puck and employ a triad of rolling spheres retained within and extending slightly beyond the flat surface of the puck. Although these pucks are satisfactory on sufficiently flat clean surfaces, their performance is significantly reduced on a rough or dirty surface. On rough surfaces, the rollers become worn out quickly. On dirty surfaces, the cavities in which the rolling spheres are situated, quickly become filled with debris, thus inhibiting the rolling action. This causes the rolls to wear a flat on one spot and further inhibits the rolling action. Loss of the rolling action causes the pucks to travel too slowly which greatly reduces the speed of the game. Also, these pucks become damaged easily when stepped on during play.

SUMMARY AD OBJECTS OF THE INVENTION

Accordingly, it is an object of this invention to provide a street hockey puck which is physically similar in size, weight and action to an official ice hockey puck.

It is another object of this invention to provide a street hockey puck which simulates, even on relatively rough or dirty surfaces, the sliding characteristics of an official ice hockey puck on ice.

It is another object of this invention to provide a relatively soft street hockey puck which is safe.

It is another object of this invention to provide a safer puck made from softer materials while simultaneously providing the low friction sliding characteristics associated with harder materials.

It is another object of this invention to provide a street hockey puck which can be returned to almost new condition by replacing the parts which become worn.

The attainment of these and related objects are achieved by placing a removable and replaceable bristle layer on each side of a cylindrical puck body to reduce the friction between the puck and the playing surface.

BRIEF DESCRIPTION OF THE DRAWINGS

The foregoing and other related objects of the invention should be more readily apparent to those skilled in the art, after review of the following more detailed description of the invention, taken together with the accompanying drawings in which.

DETAILED DESCRIPTION OF THE PREFERRED EMBODIMENTS

Figure 1:
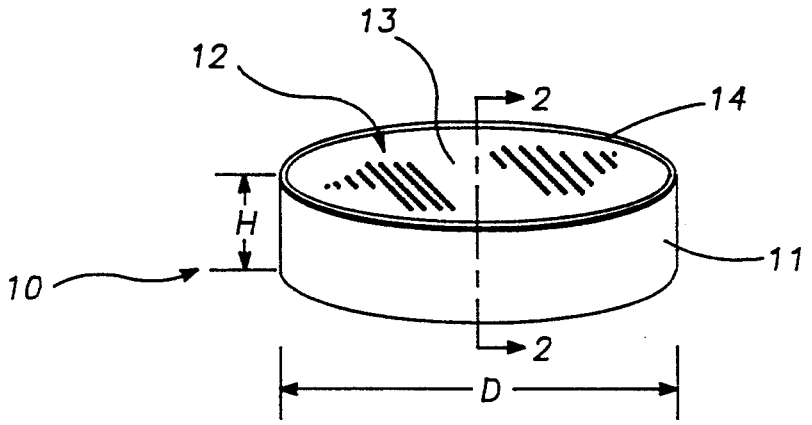
FIG. 1 is an oblique view of a preferred embodiment of the present invention.
Figure 2:
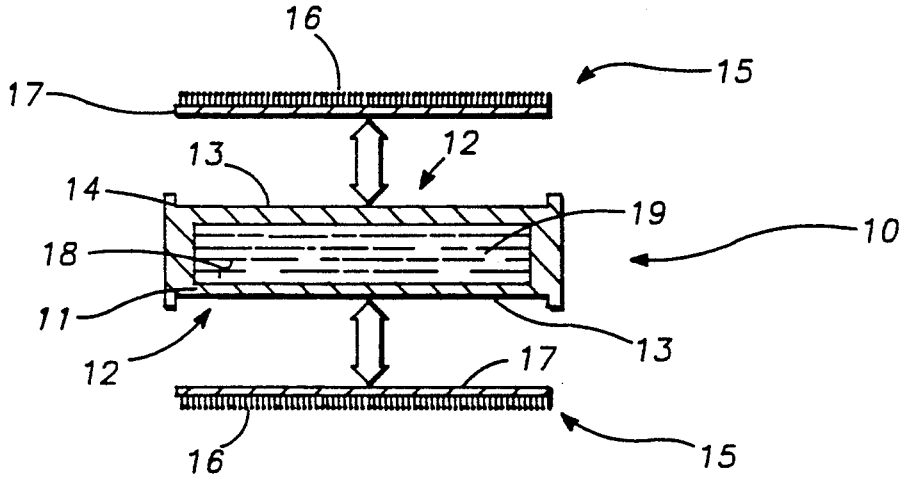
FIG. 2 is an exploded cross-sectional view taken along the lines A—A of FIG. 1.

FIGS. 1 and 2 illustrate a preferred embodiment of a hockey puck in accordance with the present invention. The cylindrical main body 11 of the puck 10 is constructed of soft thermoplastic rubbers such as urethane or foamable materials such as a soft PVC vinyl material for safety. The hardness of this material lies in the range 60–80 A on the Shore scale. The puck 10 comprises top and bottom ends 12. On each of the ends 12 is a circular depression 13 forming a rim 14. Preferably, the height of the puck, labeled as H in FIG. 1, is approximately one inch, and the diameter of the puck, labeled as D in FIG. 1, is approximately three inches to match the dimensions of an official ice hockey puck.

FIG. 2 clearly shows the circular depressions 13 in the ends 12 and the circular rim 14. Circular layers 15 of bristle material are inserted into the circular depressions 13. The bristle layer 15 comprises an adhesive backing 17 and bristles 16. The bristles 16 reduce the friction between the puck and the playing surface. Preferably the ends of the bristles are rounded and may be in the form of a ball or sphere. The hook portion of material sold under the trademark VELCRO has been found to be a very effective form of bristle. The adhesive backing 17 secures the bristle layer 15 to the surface of the depression 13.

The depth of the circular depression 13 and the height of the bristles 16 of bristle layer 15 are such that the bristles 16 extend beyond the rim 14, and the adhesive backing 17 is below the rim 14. This ensures that the puck will rest on the bristles 16 and the edge of the bristle layer 15 will not be rolled up or peeled back and removed through normal use of the puck. The bristle layer 15 can be removed and replaced when the bristles become significantly worn. This is done by simply peeling the layer from the puck and attaching a new one.

FIG. 2 also shows a central cavity 18 defined by the main body 11 and ends 12. A weight adjustment material 19 can be inserted in the cavity 18 to increase the weight of the puck. The weight adjustment material may include a thermoplastic material, water fill or any other material suitable for increasing the weight of the puck. The weight of the puck can also be increased by increasing the thickness of the main body 11 and the ends 12. Preferably, the weight of the puck should be increased to the range defined by 3.5–4.5 ounces.

What is claimed is:

1. A hockey puck for play on hard non-ice surfaces comprising:

a cylindrical may body having first and second generally parallel ends; and a layer of bristle material secured to each of said first and second ends, said bristle material having a plurality of bristles projecting therefrom.

2. A hockey puck as in claim 1 wherein said layers of bristle material are releasably secured to said first and second ends.

3. A hockey puck as in claim 1 wherein said cylindrical main body is formed of a material selected from the following group: urethane and vinyl.

4. A hockey puck as in claim 1 wherein said cylindrical main body has an axial thickness of approximately one inch, and a diameter of approximately three inches.

5. A hockey puck as defined in claim 1 wherein said bristles of said bristle material include a rounded end.

6. A hockey puck as in claim 5 wherein said bristle material is hook VELCRO material.

7. A hockey puck for play on hard non-ice surfaces comprising:

(a) a cylindrical main body having first and second ends, said ends each defining a recess; and (b) a layer of bristle material secured in the recesses of each of said first and second ends, said bristle material having a plurality of bristles projecting therefrom.

8. A hockey puck as defined in claim 7 wherein said bristles of said bristle material include a rounded end.

9. A hockey puck as in claim 8 wherein said bristle material is hook VELCRO material.

10. A hockey puck for play on hard non-ice surfaces comprising:

(a) a cylindrical main body having first and second circular ends and a wall extending between said ends, said ends and said wall defining a cavity;

(b) a weight adjustment material disposed in said cavity; and (c) a layer of bristle material secured to each of said first and second ends, said bristle material having a plurality of bristles projecting therefrom.

11. A hockey puck as in claim 10 wherein said weight adjustment material is a thermoplastic.

12. A hockey puck as in claim 10 wherein said puck, including said weight adjustment material, weighs approximately four ounces.

13. A hockey puck as defined in claim 10 wherein said bristles of said bristle material include a rounded end.

14. A hockey puck as in claim 13 wherein said bristle material is hook VELCRO material.

15. A hockey puck for play on hard non-ice surfaces comprising:

(a) a cylindrical main body having first and second circular ends and a wall extending between said ends, a circular depression in said first and second ends, said ends and said wall defining a cavity;

(b) a weight adjustment material disposed in said cavity; and (c) a layer of bristle material secured in said depressions in said first and second ends, said bristle material having a plurality of bristles projecting therefrom.

16. A hockey puck as defined in claim 15 wherein said bristles of said bristle material include a rounded end.

17. A hockey puck as in claim 16 wherein said bristle material is hook VELCRO material.

18. A hockey puck for play on hard non-ice surfaces comprising:

(a) a main body having an axial thickness of approximately one inch, a diameter of approximately 3 inches, said main body having first and second circular ends, a circular depression in said first and second ends, and a wall extending between said ends;

(b) said circular ends and said wall defining a cavity;

(c) a weight adjustment water fill disposed in said cavity; and (c) removable layers of bristle material disposed in said depressions in said first and second ends, said bristle material having a plurality of bristles projecting therefrom.

19. A hockey puck as defined in claim 18 wherein said bristles of said bristle material include a rounded end.

20. A hockey puck as in claim 19 wherein said bristle material is hook VELCRO material.

* * * * *